United States Patent [19]

Daniels

[11] 4,001,993

[45] Jan. 11, 1977

[54] STEEL WALL STUD AND THE WALL FRAME EMPLOYING THE SAME

[75] Inventor: Lawrence H. Daniels, Piedmont, Calif.

[73] Assignee: Kaiser Steel Corporation, Oakland, Calif.

[22] Filed: June 20, 1973

[21] Appl. No.: 371,764

[52] U.S. Cl. ..... 52/376; 52/660; 52/720; 85/11

[51] Int. Cl.[2] ..... E04C 2/24; E04C 2/42

[58] Field of Search ..... 52/349–352, 52/376, 377, 690, 694, 730–732, 274, 421, 380, 660, 720; 85/11, 31; 72/52, 178, 180

[56] References Cited

UNITED STATES PATENTS

| | | | |
|---|---|---|---|
| 2,771 | 9/1842 | Buckelew | 85/31 |
| 141,810 | 8/1873 | Nichols | 85/11 |
| 387,066 | 7/1888 | Greer | 85/10 R |
| 489,498 | 1/1893 | Pruden | 72/52 |
| 634,522 | 10/1899 | Daly | 85/11 |
| 1,064,363 | 6/1913 | Moore | 52/363 |
| 1,675,226 | 6/1928 | Munroe et al. | 52/376 |
| 1,830,382 | 11/1931 | Bemis | 52/585 |
| 1,959,135 | 5/1934 | Miller | 52/376 |
| 2,050,609 | 8/1936 | Howell | 52/352 |
| 2,063,010 | 12/1936 | Balduf | 52/363 |
| 2,073,781 | 3/1937 | Calafati | 52/363 |
| 2,099,470 | 11/1937 | Coddington | 52/376 |
| 2,200,159 | 5/1940 | Davis | 52/690 |

FOREIGN PATENTS OR APPLICATIONS

| | | | |
|---|---|---|---|
| 123,567 | 2/1947 | Australia | 52/90 |
| 827,035 | 2/1960 | Canada | 52/98 |

*Primary Examiner*—James L. Ridgill, Jr.
*Attorney, Agent, or Firm*—Naylor, Neal & Uilkema

[57] ABSTRACT

A sheet metal wall stud having a shape and dimensions corresponding substantially to wood studs and a cross-sectional configuration providing for rigidity and dimensional stability. A wall system employing such a stud wherein top and bottom plates of conventional lumber are employed and a strip of particle board is interposed between the ends of the metal stud and the surfaces of the plates. The ends of the stud are formed to penetrate the surface of the particle board to afford positional stability for the stud and the stud is provided with nailing extensions to attach the stud at its ends to the top and bottom plates. Wood blocks installed at the ends of the stud transmit the bearing force between the plates and the stud, and the stud is provided with improved knock-outs for the passage of utility lines therethrough. Improved nails for securing wall panels, such as gypsum board, to the studs are provided. The nails have eccentric points so that as the nail is driven through the stud, it is deformed along a curvilinear path to inhibit its withdrawal.

9 Claims, 10 Drawing Figures

STEEL WALL STUD AND THE WALL FRAME EMPLOYING THE SAME

This invention relates to an improved sheet metal stud and to a wall frame system employing the stud as an essential part.

The advantages of dimensional stability, ease of manufacture, and conservation of natural resources inherent in metal wall studs have not been realized to the fullest extent possible for various reasons. Among the reasons are that existing metal studs are provided as part of a framing system employing only metal members and requiring special tools for assembly, and that metal studs, particularly those having a general C-shape cross-section, lack the familiar "feel" of studs to which carpenters are accustomed. The present invention overcomes the above-mentioned disadvantages by providing a stud made of sheet metal formed into a closed, generally rectangular, shape that has dimensions corresponding to those of a conventional wood stud and by incorporating the metal stud into a wall frame wherein the remaining parts, e.g., the top and bottom plates, are of conventional wooden construction. One aspect of the present invention which mades the wall system feasible is that strips of particle board are placed on the faces of the plates against which the ends of the studs bear. Accordingly, the fibers of the plates, which impart the strength to the plates, are not sheared or severed by the edges of the end of the sheet metal stud since such edges bear on and, in some cases, partially penetrate the particle board strips.

Thus, the particle board strips contribute to the achievement of one of the principal objects of the present invention which is to provide a sheet metal stud that is compatible with a framing system wherein the remaining members are constructed of wood arranged in a conventional manner. Without the particle board strips, the strength of the plates would be jeopardized by the shearing action of the edges of the sheet metal at the ends of the studs.

Another object is to provide a stud that has the "feel" of a conventional wooden stud to promote acceptance thereof by carpenters. Contributing to the achievement of this object is the general boxlike configuration of the stud which closely approximates the dimensions of a conventional wood stud and is lighter in weight.

Still another object of the present invention is to provide a sheet metal stud that can be adapted to support both normal loads and extraordinary loads. The sheet metal of which the stud is constructed has adequate strength for extraordinary loads if the load is transmitted to the ends of the stud uniformly. For assuring uniform transmission of the load, a stud according to the present invention is adapted to receive, in the ends, wooden blocks which present a surface area equivalent to that of conventional wood studs so that the load is transmitted uniformly throughout the surface area of the wooden block. Nails pass through the walls of the studs into the wooden blocks and afford uniform transmission of the load from the wooden blocks to the stud. Further contributing to the transmission of the load from the wooden block to the stud is the provision, in the cross-sectional shape of the sheet metal stud, of corrugated portions which have the effect of drawing all four walls of the stud into firm contact with the wooden block in response to nailing only two opposite faces of the stud to the wooden block. The corrugations also contribute to the stiffness of the stud at the region thereof intermediate the blocks.

Yet another object of the present invention is to provide an improved fastener for securing wall panels, such as gypsum boards, onto the wall frame without employment of special tools. This object is achieved according to the present invention by the provision of special nails or nail-like members which have an eccentrically configured point thereon so that when the nails are driven through the panel boards and into the sheet metal wall of the stud, the nails are curvilinearly deformed and grip the sheet metal wall of the stud to inhibit withdrawal of the nails.

A further object of the present invention is to provide improved knock-outs so that utility lines, such as plumbing or wiring lines, can be installed in the wall of which the stud is a part. The knock-outs of the present invention are formed so that portions of the metal surrounding the knock-out opening are bent inwardly so that the boundaries of the knock-out are smooth, and thus will not endanger the integrity of the utility lines installed therethrough.

The foregoing, together with other objects, features and advantages, will be more apparent after referring to the following specification and accompanying drawing in which.

Figure 1:
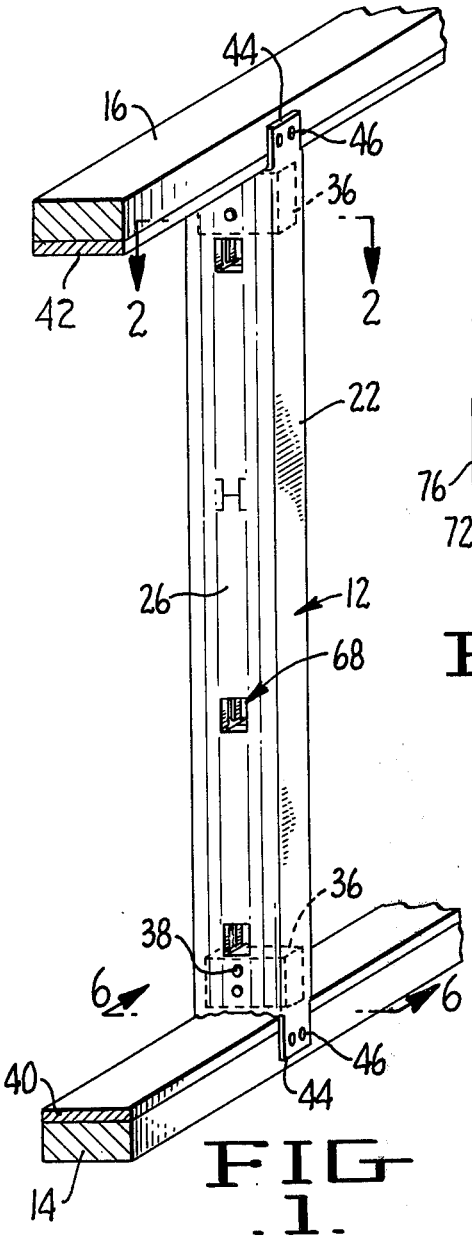
FIG. 1 is a fragmentary perspective view of a portion of a wall frame constructed according to the present invention.

Referring more particularly to the drawing, reference numeral 12 indicates a stud according to the present invention extending vertically between a bottom plate 14 and a top plate 16. The plates are conventional in that they are formed of construction lumber and are of appropriate dimension, e.g., 2 × 4 inches, nominal. Although only one stud is shown in FIG. 1, it is to be understood that additional studs are employed, typically spaced at 16 or 24 inches centers depending on structural requirements.

Figure 2:
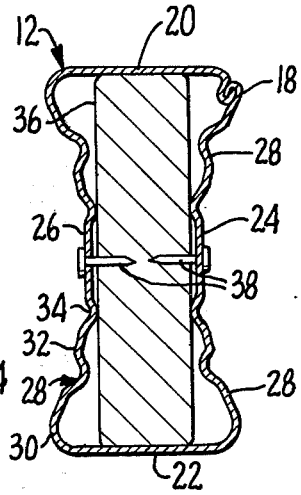
FIG. 2 is a cross-sectional view of a stud according to the present invention taken along the plane designated by line 2—2 of FIG. 1.

With reference to FIG. 2, stud 12 is seen to be formed in generally rectangular, cross-sectional configuration by sheet steel having a thickness in the range of about 0.009 to 0.015 inch, a thickness of 0.010 inch being typical. The sheet metal is jointed or seamed at 18 in order to provide a fully enclosed stud, which has improved strength and which has a more familiar feel to carpenters than C-shaped sheet metal studs or the like.

The stud has opposite walls 20 and 22, the outer surfaces of which are co-extensive with the surface of the frame of which the stud is a part. Walls 20 and 22 afford attachment of covering materials such as gypsum wall boards, or the like. The side surfaces of the stud are formed by planar mid-portions 24 and 26 and corrugated regions 28 which extend from the lateral extremities of the mid-portions to walls 20 and 22. More specifically, each corrugated portion 28 includes an outer rounded, relatively large convex portion 30, an intermediate convex portion 32, and an inner, relatively small concave portion 34. It will be noted that corrugated region 28 diverges outwardly from mid-portions 24 and 26 to walls 20 and 22 so that the space between the mid-portions is less than the thickness of the stud at curved region 30.

The corrugated portions 28 improve the stiffness of the stud and assist in retaining wooden blocks 36 within the ends of the stud when the stud is intended to support extraordinary loads. The blocks 36 have a rectangular cross-sectional area proportioned to contact the inner surfaces of the walls of the stud (See FIG. 2). Planar mid-regions 24 and 26 are provided with holes through which nails 38 are driven to retain the blocks in place. Because of corrugations 28, the inward movement of the mid-portions 24 an 26, when nails 38 are driven, causes a corresponding inward movement of faces 20 and 22 so that the side walls of the blocks are tightly embraced by all four wall surfaces of the stud.

Each block 36 has a bearing surface which is perpendicular to the longitudinal axis of the stud and which is positioned in substantially co-planar relationship to the ends of the metal stud so that the superposed load is uniformly borne by the wooden block and thence transferred to the metal walls of the stud through nails 38.

Whether or not stud 12 is provided with wooden blocks 36, there is a possibility that the relatively sharp edges of the sheet metal walls of the stud will adversely affect the fibers in plates 14 and 16. This results because the fibers extend longitudinally of the plates and serve to resist both tension and compression loads on the plates. The ability of the plate members to withstand such loads is impaired should the fibers that constitute the stud be damaged. To avoid such damage, the present invention provides for installation of particle board strips 40 and 42 on the surfaces of the respective bottom and top plates. The strips have a width corresponding to plates 14 and 16, such width being 2 ½ inches, when nominal 3 inches lumber is employed for the plates, and 3 ½ inches when nominal 4 inches lumber is employed for the plates. The particle board, because it is composed of numerous omnidirectionally oriented wood fibers bound together by adhesives, is not adversely affected by the relatively sharp end edges of the metal walls of the stud. That is to say, the surface of the particle board strips has a higher shear strength than the surfaces of the lumber of which plates 14 and 16 are formed. Such shear characteristics are typical of the particle board used in the construction industry and any particle board having such characteristics may be used. Particle board strips having a thickness of about ⅜ inch to ½ inch are adequate.

Figure 6:
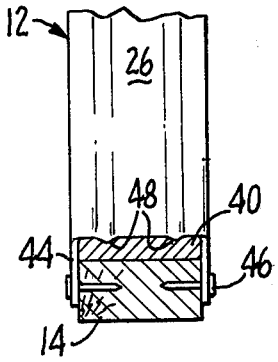
FIG. 6 is a cross-sectional view taken along the plane designated by line 6—6 of FIG. 1 showing the end of the stud bearing against the bottom plate.

In constructing the wall, strips 40 and 42 can be temporarily nailed or glued in place, but the strength of the frame does not depend on such fastening expedients. For retaining the parts of the wall frame in place, the walls 20 and 22 include portions 44 that extend beyond the end of the stud into face-to-face contact with the vertical faces of the plates (See FIG. 6). The portions 44 are provided with one or more holes through which nails 46 are driven into the plates. Also contributing to the rigidity of the wall frame are protuberances 48 (See FIG. 6) which extend beyond the end edges of the stud and are preferably in longitudinal alignment with intermediate curved portion 32 of corrugation 28. The protuberances penetrate the surface of particle board strip 40 and in addition to assisting in retaining the stud in place also retain the particle board strips in place. Protuberances having a length of about 0.030 inch afford the desired function.

In constructing a wall frame employing stud 12, the plates 14 and 16 are first prepared by placing particle board strips 40 and 42 thereon after which the studs are fastened to the plates, as is conventional. The presence of the portions 44 assists in alignment of the studs with the plates and obviates the need for toe nailing.

Figure 3:
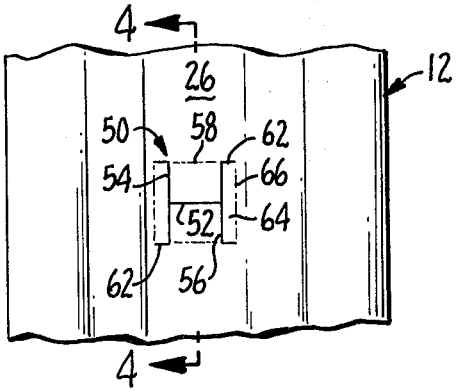
FIG. 3 is a detailed fragmentary view in enlarged scale of a knock-out according to the present invention.
Figure 4:
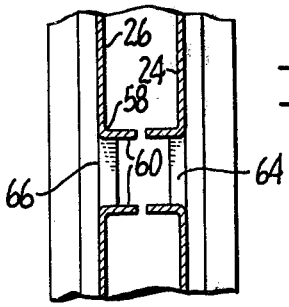
FIG. 4 is a cross-sectional view taken along the plane designated by line 4—4 of FIG. 3 showing the opening through the stud afforded by the knock-out.

The stud of the present invention includes one or more knock-outs so that utility lines can be installed horizontally therethrough. An exemplary knock-out 50 is shown in FIG. 3. The knock-out is formed by a horizontally extending slit line 52 and vertically extending slit lines 54 and 56 which extend above and below the horizontal slit line and define a generally H-shaped configuration. Thus, it will be seen that upper and lower, generally rectangular, panels are formed which are joined to the stud wall by webs 58 which are indentified by broken lines in FIG. 3. When bent inwardly to form the knock-out, these rectangular panels, designated by reference numeral 60, define smooth surfaces at two sides of the knock-out. For similarly providing smooth regions at the remaining two sides of the knock-out, there are formed end slit lines 62 which extend outwardly from the upper and lower ends of slit lines 54 and 56. The slit lines 62 provide rectangular panels 64, which are boundaried at the upper and lower extremities by end slit lines 62, at the inner extremities by slit lines 54 and 56, and at the outer extremities by a web of sheet metal 66. Thus, when panels 64 are bent inwardly along webs 66, all four sides of the knock-out opening are defined by smooth sheet metal surfaces so that utility lines can be installed through the stud without damage thereto. As is clear from FIG. 4, the above-described arrangement of slit lines is formed in both mid-portions 24 and 26 in alignment with one another so that when the rectangular panels are bent inwardly from each side, an opening through the stud is defined. Such opening can be seen at 68 in FIG. 1.

In the preferred embodiment, knock-outs 50 are disposed adjacent the ends of the stud so that the bent-in panels thereof may also serve as abutments for the blocks 36.

Figure 5:
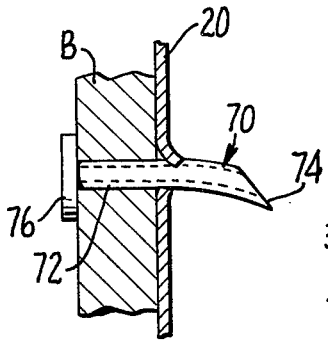
FIG. 5 is a view at enlarged scale of a fastener for securing panel boards to the stud of the present invention.
Figure 8:
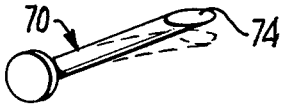

Comprehended within the present invention is a novel fastener for securing wall panels, such as gypsum boards and the like, to the studs. The fasteners can be installed by means of a hammer, rather than self tapping screws or like expedients requiring special tools, a factor which enhances the acceptability of the stud to carpenters who are accustomed to working with wood studs. FIG. 5 shows in cross-section a fastener 70 according to the invention. The fastener includes a shank 72 which has an eccentric pointed end 74. In the embodiment of the fastener shown in FIGS. 5 and 8, the shank is cylindrical, and pointed portion 74 is formed by obliquely shearing the stock from which the shank is made. The shearing operation is carried out to provide an eccentric point and is preferably oriented so that the included angle between the side wall of the shank and the surface of the shear is an acute angle. In any event, the eccentric configuration of point 74 is such that as the shank pierces stud wall 20, the shank is curvilinearly deformed, as shown in FIG. 5, so as to inhibit withdrawal of the fastener. The fastener at the end opposite pointed portion 74 has a head 76, the inner surface of which forms an abutment that bears against the wall board B to retain the same onto the studs. Fastener 70 is subject to being embodied in various configurations.

Figure 7:
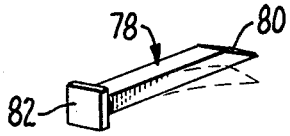
FIGS. 7–10 are perspective views of exemplary fasteners for securing panel boards to the studs of the present invention.

The fastener 78 of FIG. 7 has a square cross-sectional shape and has a pointed region 80 which is eccentric of the central axis of the fastener so that when the fastener pierces the sheet metal wall of the stud, the shank is curvilinearly deformed as shown in broken lines in FIG. 7. A square head 82 defines an abutment which engages the outer surface of the wall board material so as to retain it in place.

Figure 9:
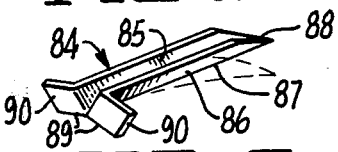

Another modification of the fastener is shown at 84 in FIG. 9. Fastener 84 is formed by two flat plates 85 and 86 which are formed of a unitary member by bending the same along a line 87 which defines the apex of a V-shaped cross-section. Fastener 84 has an eccentrically pointed portion 88 which, as it pierces the sheet metal stud wall, causes the shank of the fastener to deform along a curvilinear path shown by broken lines in FIG. 9. At the end remote from pointed portion 88, a portion of the apex is slit at 89 and the portions of plates 85 and 86 adjacent the slit are bent perpendicularly to form abutments 90 which bear against the outer surface of the wall board and retain it in place.

Figure 10:
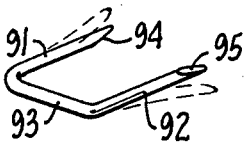

Yet another modification of a fastener according to the present invention is shown in FIG. 10. The fastener is a staplelike member that has opposite shafts 91 and 92 which are supported in parallel spaced relation by a perpendicular cross-member 93. Cross-member 93 defines an abutment that engages the panel board and retains it in place against the stud. The opposite ends of shafts 91 and 92 have eccentrically formed pointed portions 94 and 95, the pointed portions being oriented obliquely of one another so that when the fastener is driven through the metal wall of the stud and the pointed portions pierce the metal wall, the shafts are curvilinearly deformed in opposite directions as shown in broken lines in FIG. 10.

It has been found that optimum deformation of the fasteners is achieved if the metal of which the stud is made has a higher yield strength than the metal of which the fasteners are made. The fastener, even though of a lower yield strength, can readily pierce the stud because of the pointed portion, at one end thereof. Once the shank pierces the stud, it is deformed because of its relatively lower yield strength. More specifically, it has been found that the sheet metal of which stud 12 is constructed should have a yield strength in the range of about 50,000 psi to about 90,000 psi for optimum results. With a stud of this nature, steel nails having a yield strength in the range of about 30,000 psi to about 40,000 psi have adequate strength to retain the panel board in place and to curvilinearly deform when driven through the wall of the stud.

Thus, it will be seen that the present invention provides an improved stud and wall frame employing the stud which achieves all of the advantages of sheet metal studs while being compatible with wooden framing members for the remainder of the wall frame of which the stud is a part. This not only speeds up construction, but makes the stud more acceptable to workmen accustomed to working only with wooden members. Further contributing to the acceptance of the stud of the invention is an improved fastener which can be driven by a hammer and which firmly retains the wall board or like wall covering in place on the wall frame. Although one embodiment of the invention has been shown and described, it will be obvious that other adaptations and modifications can be made without departing from the true spirit and scope of the invention.

What is claimed is:

1. A wall frame comprising a bottom wooden plate coextensive with the lower boundary of the frame, said bottom plate having opposite vertical faces and an upper horizontal surface extending between said vertical faces, a first strip of particle board coextensive with and overlying said upper horizontal surface, said first strip having an upper surface with a shear strength higher than that of the upper horizontal surface of the bottom plate, a plurality of studs extending upward from said bottom plate and first strip, each of said studs having a lower end bearing on said first strip and four sheet metal walls formed in a closed, generally rectangular, hollow cross-sectional shape with the lower edge of at least one of said walls disposed in bearing engagement with the upper horizontal surface of the first strip, said studs having a depth corresponding to the width of the bottom plate so that two opposing walls of each of the studs lie in general coplanar relation to the respective opposite vertical faces of said bottom plate, each of said studs having an upper end opposite said lower end, a second strip of particle board supported on the upper ends of said studs, a top wooden plate overlying said second strip of particle board, said second strip having a lower surface with shear strength higher than that of lower surface of the upper plate, said lower surface of the second strip being disposed in bearing engagement with the upper edge of at least one wall of each of the studs on which the strip is supported, and stud retaining means for retaining said upper and lower ends of said studs to said top and bottom plates.

2. A wall frame, according to claim 1, wherein said stud retaining means includes portions of said opposite stud walls extending beyond the upper and lower ends of the studs and into face-to-face relation to the vertical faces of said plates, said extending portions each having at least one hole therein opposite the vertical face of the plates, and a fastener extending through the hole into the plate.

3. A wall frame, according to claim 1, wherein said stud retaining means includes rigid protuberances fixed to extending longitudinally from the upper and lower ends of the studs, said protuberances being shaped to penetrate the upper and lower surfaces, respectively, of the first and second strips.

4. A wall frame, according to claim 1, in combination with at least one panel board secured to one of the opposing sheet metal walls.

5. A wall frame, according to claim 1, in combination with a wooden block having a rectangular cross-sectional shape proportioned to engage simultaneously the interior surfaces of said four sheet metal walls, said wooden block having a cross-sectional bearing surface at one end thereof, and means for fastening said wooden block within said stud in a position wherein said bearing surface is substantially coplanar with one end of said stud so that said bearing surface contacts the particle board strip at said one end of the stud.

6. A wall frame, according to claim 5, wherein said fastening means includes at least one nail driven through one of said sheet metal walls into said block.

7. A stud for use in constructing a wall frame comprising a sheet metal strip bent into a closed, generally rectangular, hollow cross-sectional shape to define four walls, at least one of said walls having a corrugated region extending longitudinally of the stud to impart stiffness thereto, said stud at one end thereof having a protuberance in alignment with the corrugation to form a rigid extension thereof extending from said one end, said protuberance affording penetration of a wood plate installed at the said end.

8. A stud for use in constructing a wall frame, said stud comprising a sheet metal strip bent into a closed, generally rectangular, hollow cross-sectional shape, said shape including first and second opposite parallelly spaced apart faces that define the surfaces of the frame, said stud having third and fourth walls spanning the extremities of said first and second walls, said third and fourth walls having a depth corresponding to the thickness of the wall frame, said third and fourth walls each having a mid-portion and a corrugated portion that diverges outward of said mid-portion to said extremities so that inward displacement of the mid-portions of said third and fourth walls toward one another causes inward movement of said first and second walls toward one another, and a nailable block contained within each end of the stud, said blocks having a generally rectangular cross-sectional shape proportioned to simultaneously contact the interior surfaces of said first and second walls and the interior of the planar mid-portions of said third and fourth walls, said planar mid-portions providing surfaces through which nails can be driven into the nailable blocks to draw the first and second walls toward one another and against the block.

9. A stud, according to claim 8, wherein the third and fourth walls have aligned knockouts for affording installation of utility lines through the studs, said knockouts being formed by:

a. an H-shaped slit having a horizontal center slit line and vertically extending end slit lines that intersect said center slit line and extend above and below said center slit line to define upper and lower substantially rectangular panels boundaried on three sides by said slit lines and on a fourth side by a web of material extending between the extremities of the end slit lines; and, b. horizontal lateral slit lines extending outward of the extremities of said end slit lines to define right and left rectangular panels boundaried on three sides by said end slit lines and said lateral slit lines and on a fourth side by a web of metal extending between the extremities of the lateral slit lines; said upper, lower, right and left panels being bendable inwardly to form a rectangular opening through the stud that is boundaried on all four sides by said webs.

* * * * *